US011517830B2

(12) United States Patent
Parsons et al.

(10) Patent No.: US 11,517,830 B2
(45) Date of Patent: Dec. 6, 2022

(54) PLAY APPARATUS

(71) Applicant: FUREAI LTD, Carmunnock Clarkston Glasgow (GB)

(72) Inventors: Simon Parsons, Glasgow (GB); Gordon Ross, Auchterarder Perth and Kinross (GB); Anthony James Bibby, Brightons Nr. Falkirk Stirling (GB)

(73) Assignee: FUREAI LTD, Glasgow (GB)

( * ) Notice: Subject to any disclaimer, the term of this patent is extended or adjusted under 35 U.S.C. 154(b) by 311 days.

(21) Appl. No.: 16/640,277

(22) PCT Filed: Jun. 29, 2018

(86) PCT No.: PCT/GB2018/051848

§ 371 (c)(1),
(2) Date: Feb. 19, 2020

(87) PCT Pub. No.: WO2019/038512

PCT Pub. Date: Feb. 28, 2019

(65) Prior Publication Data

US 2020/0360829 A1 Nov. 19, 2020

(30) Foreign Application Priority Data

Aug. 24, 2017 (GB) ..... 1713651

(51) Int. Cl.
*A63H 30/02* (2006.01)
*A63F 7/00* (2006.01)
*A63H 33/18* (2006.01)

(52) U.S. Cl.
CPC ..... *A63H 30/02* (2013.01); *A63F 7/0058* (2013.01); *A63H 33/18* (2013.01); *A63H 2200/00* (2013.01)

(58) Field of Classification Search
None
See application file for complete search history.

(56) References Cited

U.S. PATENT DOCUMENTS 4,844,475 A * 7/1989 Saffer ..... A63F 13/04 434/20
4,995,374 A * 2/1991 Black ..... A01K 15/025 124/32
5,041,044 A 8/1991 Weinreich
(Continued)

FOREIGN PATENT DOCUMENTS

JP 2010042085 A 2/2010
WO 2016172815 A1 11/2016

OTHER PUBLICATIONS

ISR for PCT/GB2018/051848, dated Oct. 15, 2018, 3 pages.

*Primary Examiner* — Tramar Harper
(74) *Attorney, Agent, or Firm* — Brooks Kushman P.C.

(57) ABSTRACT

A play apparatus has a pair of devices. Each device has: a capture arrangement such as a cavity to capture an object such as a ball; an object detector to detect that the object has been captured; a transmission module to transmit a release signal; a receiver module to receive a release signal; and a release actuator to release the captured object. A first device detects capture of a first object, transmits a first release signal to cause a second device to release a second object. The first device withholds the first object until releasing it responsive to receipt of a second release signal indicating that another object has been captured by the second device.

15 Claims, 13 Drawing Sheets

(56) References Cited

U.S. PATENT DOCUMENTS

| | | | | |
|---|---|---|---|---|
| 5,397,133 | A * | 3/1995 | Penzias | A63F 13/12 463/40 |
| 6,009,458 | A | 12/1999 | Hawkins et al. | |
| 6,359,549 | B1 * | 3/2002 | Lau | G08B 3/10 381/94.1 |
| 6,772,745 | B2 * | 8/2004 | McEachen | A63B 69/406 124/51.1 |
| 9,144,746 | B2 * | 9/2015 | Cannon | A63H 3/28 |
| 9,320,960 | B1 * | 4/2016 | Ward | A63B 69/408 |
| 2006/0154711 | A1 * | 7/2006 | Ellis | A63F 13/12 463/30 |
| 2008/0211771 | A1 | 9/2008 | Richardson | |
| 2013/0120364 | A1 | 5/2013 | Aldridge et al. | |
| 2013/0228138 | A1 * | 9/2013 | Hamill | A01K 15/027 124/78 |
| 2014/0274370 | A1 | 9/2014 | Shah | |

* cited by examiner

PLAY APPARATUS

CROSS-REFERENCE TO RELATED APPLICATIONS

This application is the U.S. national phase of PCT Application No. PCT/GB2018/051848 filed on Jun. 29, 2018, which claims priority to GB Patent Application No. 1713651.6 filed on Aug. 24, 2017, the disclosures of which are incorporated in their entirety by reference herein.

The present invention relates to a play apparatus and method.

BACKGROUND

There are times when a parent is absent from their young child, for example when they are travelling and leave the child at home with their spouse.

Parents can communicate with their pre-linguistic children when they are absent using conventional communication tools such as video conferencing.

However, such audio-visual communication only provides a limited connection between the parent and child, to the detriment of their emotional relationship.

SUMMARY OF INVENTION

It would be desirable for parents and children to satisfy their need to connect and enhance their emotional relationship by supporting tactile play, which provides a better connection between the parent and child (or between two users irrespective of age).

According to a first aspect of the present invention, there is provided a play apparatus comprising a pair of devices, each device comprising:

a capture arrangement configured to capture an object;

an object detector operable to detect that the object has been captured;

a transmission module operable to transmit a release signal;

a receiver module operable to receive a release signal; and a release actuator operable to release the captured object, wherein a first device of the pair of devices is operable to:

respond to detection of capture by the first device of a first object, transmit a first release signal configured to cause a second device of the pair of devices to release a second object; and withhold the first object until releasing it, responsive to receipt of a second release signal configured to indicate that another object has been captured by the second device.

Preferably, the capture arrangement comprises a cavity.

Preferably, the cavity is configured to conceal the captured object until it is revealed by its release.

Preferably, the capture arrangement comprises a magnet.

Preferably, the capture arrangement comprises a platform.

Preferably, the release actuator is operable to release the captured object by ejecting it.

Preferably, the second device is operable to:

receive the first release signal transmitted by the first device;

responsive to the first release signal, release the second object;

detect that the other object has been captured by the second device; and responsive to the detection of the capture of the other object by the second device, transmit the second release signal to the first device.

Preferably, the play apparatus further comprises a media output device operable to output to a user of the first device an indication of the second object having been released by the second device in response to the first release signal.

Preferably, the play apparatus further comprises a media acquisition device operable to acquire and transmit media representing the second object having been released by the second device in response to the first release signal, for output by the media output device.

Preferably, the play apparatus comprises a media output device operable to output to a user of the first device an indication of an object being captured by the second device.

Preferably, the play apparatus further comprises a media acquisition device operable to acquire and transmit media representing the other object being captured by the second device.

Preferably, the play apparatus further comprises a media sequence module operable to generate a media sequence having a duration dependent on latency from the transmission of the first release signal to the release of the second object, for output by the media output device.

Preferably, the play apparatus further comprises a media sequence module operable to generate a media sequence responsive to user input, between the detection of the capture the first object and the release of the second object, for output by the media output device.

Preferably, the media sequence module is operable to superimpose the media sequence over an output real-time media sequence representing a user of the second device.

Preferably, each device comprises an attribute detector operable to detect an attribute of an object upon its capture and wherein the transmission module of the first device is further operable to transmit a first attribute signal configured to cause the second device to apply the attribute to the second object.

Preferably, each device comprises an attribute actuator operable to apply an attribute to an object.

Preferably, applying the attribute comprises imparting a force to the object.

Alternatively, applying the attribute comprises selecting an object to release from a plurality of objects captured in the device from which the selection is made.

Preferably, the object comprises a ball.

According to a second aspect of the present invention, there is provided a method comprising the steps:

capture a first object by a first device;

detect that the first object has been captured by the first device;

responsive to the detection, transmit a first release signal from the first device configured to cause a second device to release a second object; and withholding of the first object by the first device until releasing it responsive to receipt of a second release signal configured to indicate that another object has been captured by the second device.

Preferably, the step of releasing the first object comprises ejecting it.

Preferably, the method further comprises the step of outputting to a user of the first device an indication of the second object having been released by the second device in response to the first release signal.

Preferably, the step of outputting to the user an indication of the second object having been released comprises acquiring and transmitting media of the second object having been released by the second device in response to the first release signal.

Preferably, the method further comprises the step of outputting to a user of the first device an indication of an object being captured by the second device.

Preferably, the step of outputting to the user an indication of an object being captured comprises acquiring and transmitting media of the other object being captured by the second device.

Preferably, the method further comprises the steps: generate and output a media sequence having a duration dependent on latency from the transmission of the first release signal to the release of the second object.

Preferably, the method further comprises the steps: generate and output a media sequence responsive to user input, between the detection of the capture the first object and the release of the second object.

Preferably, the method further comprises superimposing the media sequence over an output real-time media sequence representing a user of the second device.

Preferably, the method further comprises the step of detecting an attribute of the first object upon its capture by the first device and transmitting a first attribute signal configured to cause the second device to apply the attribute to the second object.

Preferably, the method further comprises the step of applying the attribute to the second object.

Preferably, applying the attribute comprises imparting a force to the second object.

Alternatively, applying the attribute comprises selecting an object to release as the second object from a plurality of objects captured in the second device.

Preferably, the method further comprises the step of modifying the attributes.

Preferably, the step of modifying the attributes is responsive to user input.

Preferably, the method further comprises the step of detecting an attribute of the other object upon its capture by the second device and transmitting a second attribute signal configured to cause the first device to apply the attribute to the first object.

Preferably, the method further comprises the step of applying the attribute to the first object.

Preferably, applying the attribute comprises imparting a force to the first object.

Alternatively, applying the attribute comprises selecting an object to release as the first object from a plurality of objects captured in the first device.

Preferably, the method further comprises the steps:

receive the first release signal;

responsive to the first release signal, release of the second object by the second device;

detect that the other object has been captured by the second device; and responsive to the detection of the capture of the other object by the second device, transmit the second release signal to the first device.

Preferably, the method further comprises the step of concealing the captured object in a cavity until it is revealed by its release.

Preferably, the method further comprises the step of supporting the captured object on a platform until it is released.

Preferably, the object comprises a ball.

BRIEF DESCRIPTION OF DRAWINGS

Embodiments of the present invention will now be described, by way of example only, with reference to the drawings, in which.

DESCRIPTION OF EMBODIMENTS

Embodiments of the present invention allow a parent and child to engage in unstructured play, by providing remote, two-way, real-time, tactile "passing" of objects.

Embodiments of the present invention create the impression that a real object has been transferred from one location to another in real time. Embodiments enable dialogic communication and play without the use of language via tangible interfaces that extend the play-space beyond the screen into the physical space around it.

Figure 1:
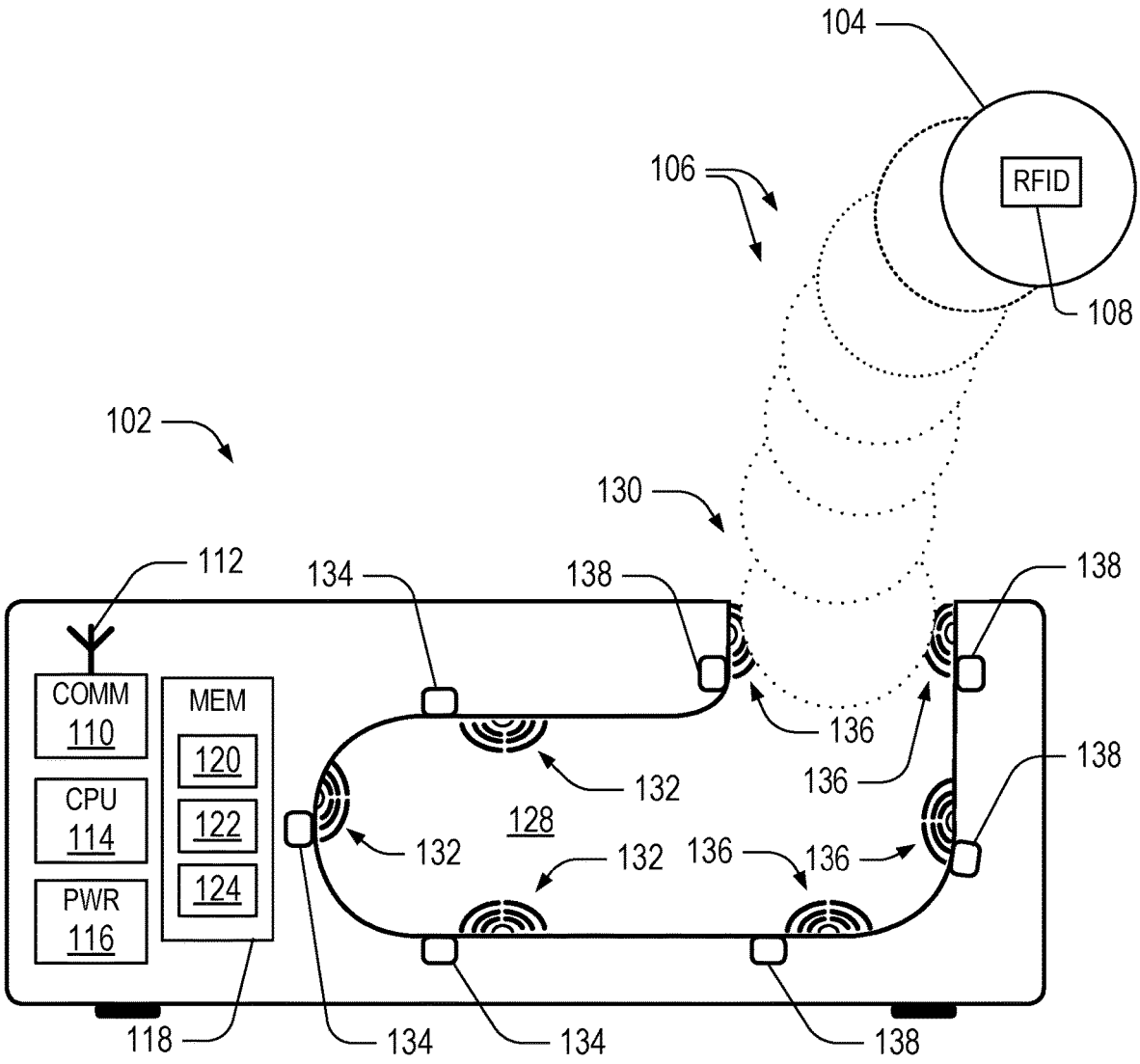
FIG. 1 illustrates, in schematic form, a play device in accordance with an embodiment of the present invention.

FIG. 1 illustrates a play device in accordance with an embodiment of the present invention. A play apparatus has a pair of play devices. The two play devices connect remotely via communication links such as the internet. The play devices can work in tandem with existing communication apparatus such as tablet computers running Microsoft™ Skype™ or Apple™ Facetime™. The operation of the devices is reversible. In the disclosure herein, devices are referred to as first and second devices, but they may be identical and interchangeable.

With reference to FIG. 1, a play device 102 is used with an object, in this example a ball 104. The ball is shown moving 106, having being ejected from the play device 102. The ball 104 has an RFID (Radio-Frequency IDentification)

tag 108 embedded within it. The RFID tag may activate a specific game or activity when dropped into the device. Different balls thus may control different games and activities. A ball may be approximately the size of a golf ball.

In the description of FIG. 1 below, some reference is also made (in parenthesis) to FIG. 2, which illustrates operation of a play apparatus having two of the devices illustrated in FIG. 1.

The device has a communication interface (COMM) 110 with an antenna 112, for wireless communication, such as using WiFi™, although wired communication could be used. A central processing unit (CPU) 114 and power supply (PWR) 116 are also provided. The CPU 114 controls the operation of the device and its communication. Although a CPU is convenient, the present invention is not limited to needing a CPU or other computing device. Instead other electrical circuits could be used with the detectors to trigger the sending of a release signal to the other device, or to release an object responsive to a release signal.

The memory 118 stores various program modules, which are executed by the processor to control other components of the device. These include a transmission module 120 operable to transmit a release signal, using the communication interface 110. A receiver module 122 is operable to receive a release signal, using the communication interface 110.

A media sequence module 124 is provided and its operation is described below with reference to FIGS. 4 and 5.

The device 102 has a capture arrangement, in this example a cavity 128, configured to capture (at 206 in FIG. 2) a ball 104. The ball enters and leaves the cavity through a hole 130. The cavity is configured to conceal the captured ball until it is revealed by its release. This can convince a small child that the ball has disappeared and is "teleported" to the other device. Even if the user is aware that the ball is merely hidden, the concealment helps them "play along" and suspend disbelief to continue enjoying playing.

One or more object detector 132 is operable to detect (at 210) that the ball has been captured. The object detector 132 is connected to the CPU to provide detection signals to the CPU.

The device is operable to withhold (at 210-226) the captured ball until releasing it using one or more release actuator 134. The release actuator 134 may be used, under control of the CPU, for example to allow the ball to drop under the influence of gravity. It may be used to eject the ball, with the release actuator being all or part of a firing mechanism that fires the ball. The actuator may use DC motors or stepper motors. The release actuator may be spring-loaded, using a compression spring or a torsion spring. A motor, such as a servo may pull back the spring.

One or more attribute detector 136 is operable to detect one or more attribute of a ball upon its capture. The attribute detectors 136 are connected to the CPU to provide attribute signals to the CPU. Attributes can include motion attributes such a velocity, angle and spin. Attributes may also include visual attributes such as colour and pattern. An attribute detector may function as the object detector.

In the case where the attribute is intrinsic to the object (for example colour) the play device can identify and select an appropriate coloured object before attaching the remaining attributes to it. Thus, applying an attribute involves selecting an object to release. In that case there are two or more objects captured in the device from which the selection is made.

The transmission module 120 of the first device is further operable to control the communication interface 110 to transmit one or more first attribute signal configured to cause the second device to apply the one or more attribute to the second ball.

One or more attribute actuator 138 is operable to apply one or more attribute to an object. The attribute actuator 138 may be used, under control of the CPU, to apply a motion attribute (at 216) by imparting a force to the ball. The attribute actuator may thus be part of a firing mechanism that fires the ball with a speed, angle and/or spin that corresponds to the motion of the other ball when captured by the other device. An attribute actuator may function as the release actuator.

Other attributes may be metadata, which may be stored in the RFID tag of the ball, being read by an RFID reader as the attribute detector 136. The metadata may for example be used to identify a sound attribute, which is applied to the ball when released by the other device by playing the sound.

Attributes may be for example a surface pattern (or texture) detected on a ball (or other object). The surface texture may then be applied to the object by superimposing the identified texture on the ball's representation in a video sequence. For example, the parent may have just one ball with a marker pattern on it. The child may choose one of several balls, such as one having a particular image of its favourite comic character on its surface. The child's play device recognises the attribute of that particular image and the parent's (or child's) play device or tablet computer can augment the reality of the patterned ball at the parent's end by applying the particular image as a texture to the surface of the parent's ball (using the marker pattern for texture registration) in the video sequence of the parent in real time. The end result is that the child thinks they have passed the selected ball to the parent, whereas the parent only needs to have just one ball. The parent's tablet computer can display a notification of which ball the child passed to them, to help them talk about it with the child, if the parent doesn't notice which ball is inserted by the child into their play device. Additionally, or alternatively, an attribute may be a 3D shape of an object, which can be similarly rendered using augmented reality. Other ways of applying a surface texture include illuminating a ball from inside using LEDs or using e-ink to apply patterns to a ball or both balls.

Figure 2A:
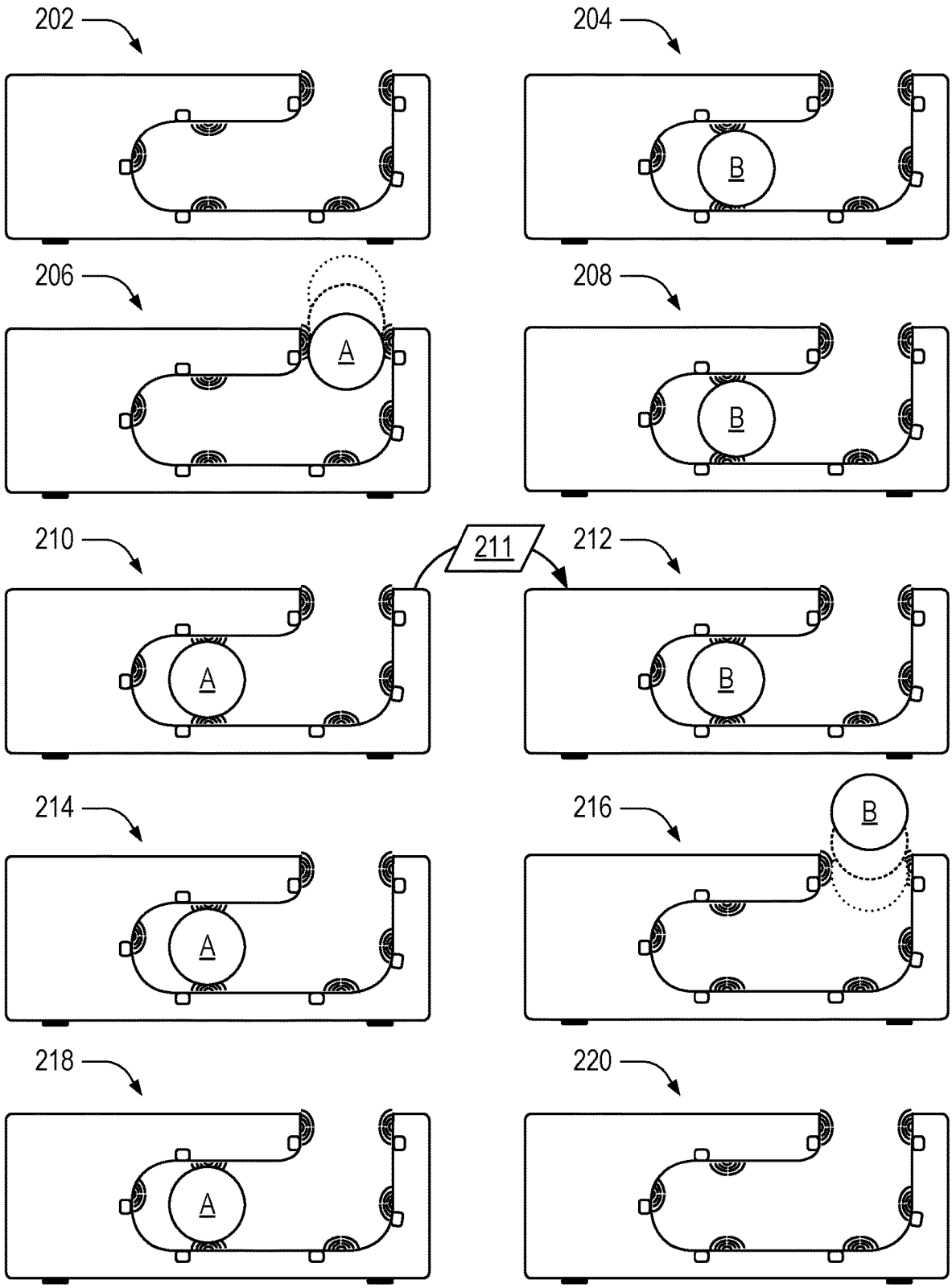
FIG. 2 illustrates, in schematic form, operation of a play apparatus in accordance with an embodiment of the present invention.
Figure 2B:
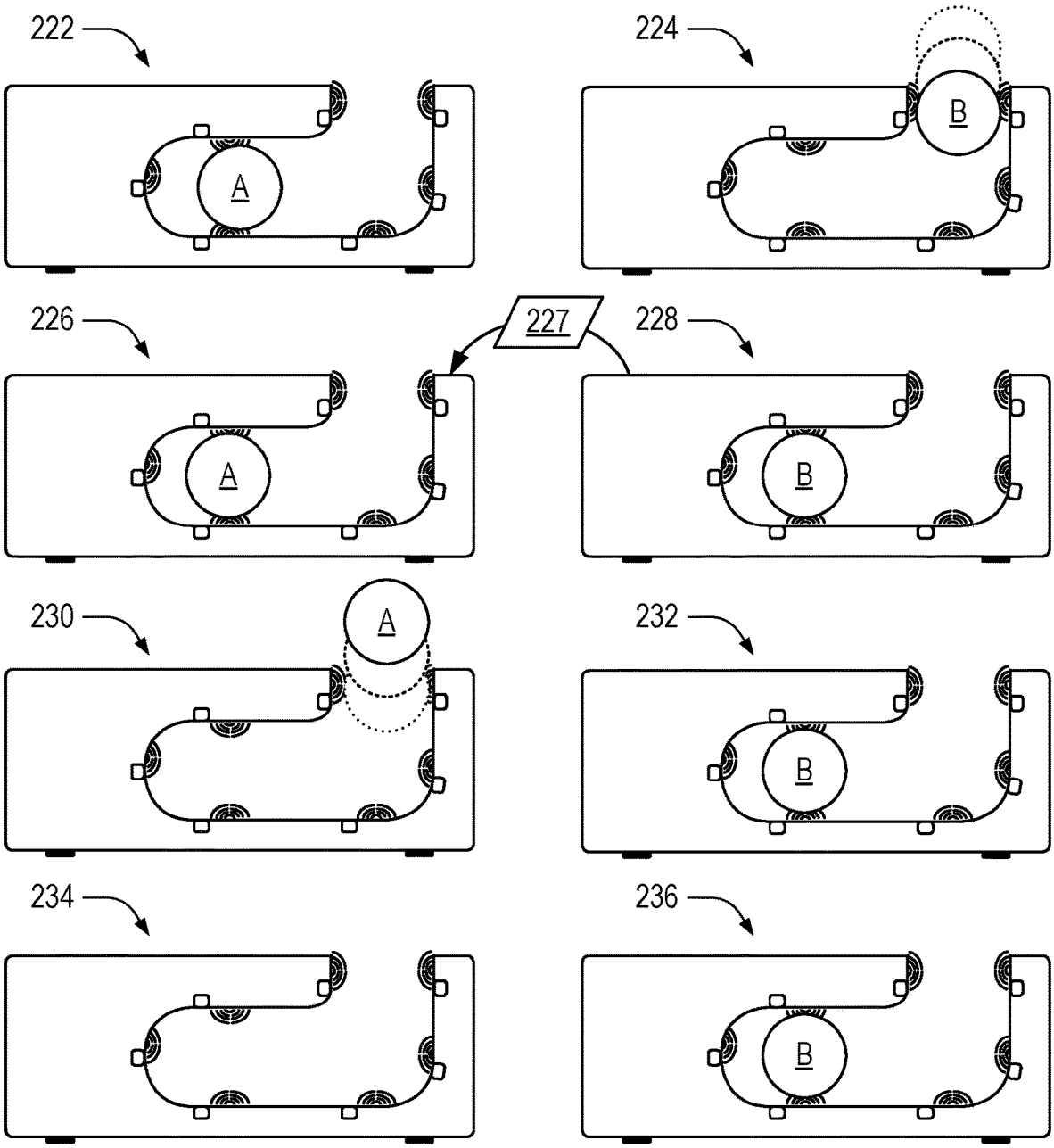

With reference to FIG. 2, operation of a play apparatus having two of the devices illustrated in FIG. 1 is illustrated.

A first device is initially empty at 202 with no ball captured in it. A ball B is captured in the second device at 204.

A first ball A is thrown, pushed or dropped into the first device at 206. The ball B is withheld in the second device at 208. The object detector detects the capture of the ball A at 210, or if using detectors close to the hole, at 206.

The first device withholds the first ball at 210, 214, 218, 222, 226 until releasing it at 230.

Responsive to detection of the capture by the first device of the ball A, at 210 the first device transmits a first release signal 211 configured to cause the second device to release a second ball B. The release signal 211 may be an explicit command or code instructing release. The release signal 211 may be in the form of a control signal encoding attributes to be applied to the second object. Thus, the release is implicitly signalled and the release signal comprises an attribute signal. The release signal may be relayed or transformed or the release information may be transferred from one signal to another during its transmission between the devices. For example, an intermediate server may receive the release signal and generate a new release signal that is sent on to the other device. In that example, the release signal is still to be interpreted as being transmitted from one device to another.

The second device receives at 212 the first release signal 211. Responsive to the first release signal 211, the second device releases the second ball B at 216.

At this stage, the user of the first device has "passed" their ball A to the second device's user, who receives ball B. The first device at 218 withholds and conceals the captured ball A, while the second device is empty at 220.

The user of the second device can catch the ball B. The user of the first device can see that happening by use of a video conference call. The user of the second device then passes the ball back to the first device's user by throwing, pushing or dropping it into the second device at 224.

The second device detects at 224 or 228 that the other object (which may actually be the ball B or a different object) has been captured by the second device.

Responsive to the detection of the capture of the other object by the second device, the second release signal 227 is transmitted to the first device. Thus the second release signal 227 indicates that another object has been captured by the second device. In this example, the second device transmits the second release signal 227, but it may be transmitted for example by an intermediate server, which has been informed of the detection of the capture at 224 or 228.

At 230, the first device releases the ball A responsive to receipt of the second release signal 227. At 232, the second device withholds the other ball B.

This takes the play apparatus back to the initial state, thus devices at 234 and 236 are in the same state as the devices at 202 and 204.

Figure 3:
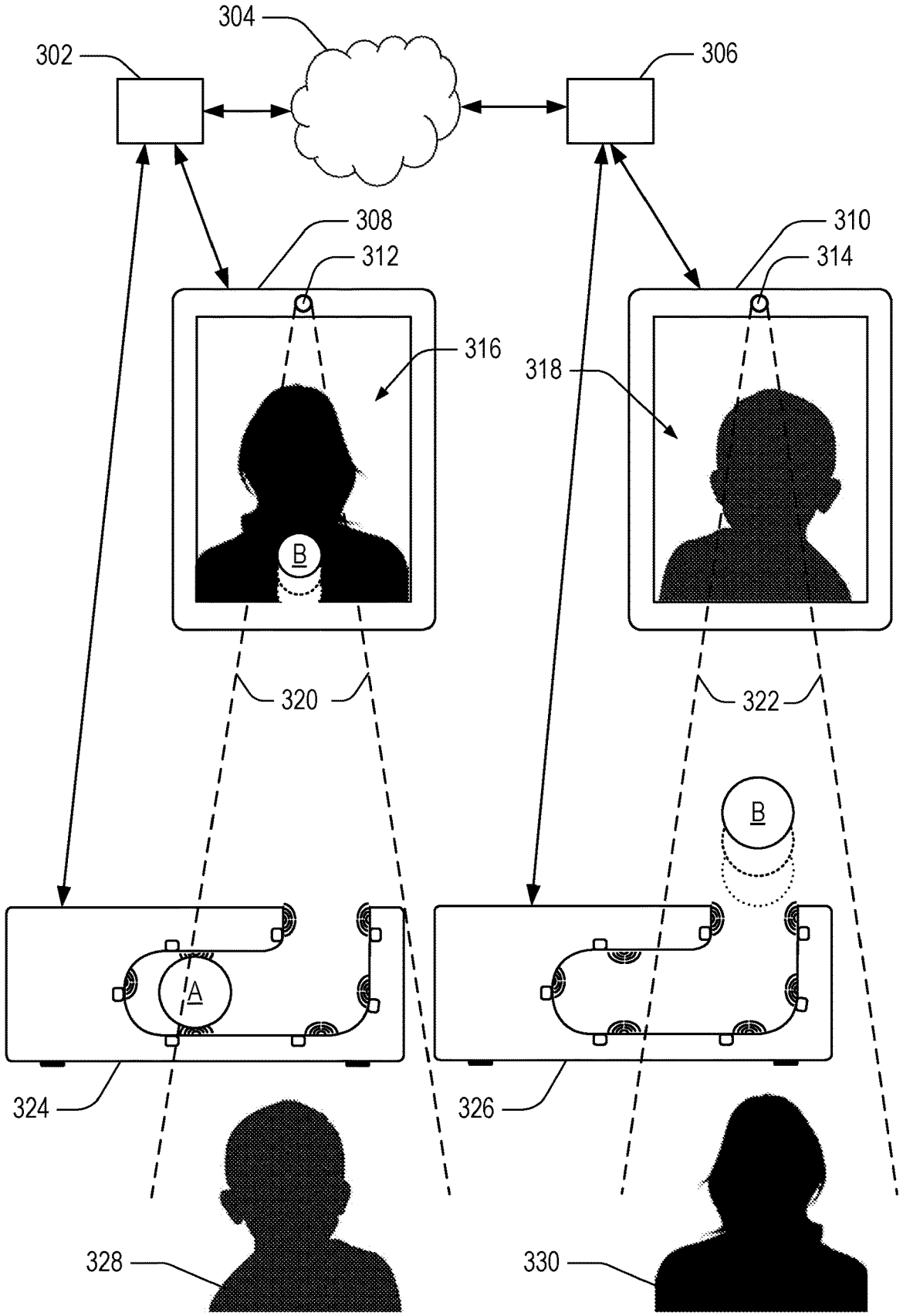
FIG. 3 illustrates, in schematic form, operation of a play apparatus in accordance with an embodiment of the present invention.

FIG. 3 illustrates operation of a play apparatus in accordance with an embodiment of the present invention. Devices 324 and 326 are shown in the state corresponding to 214 and 216 respectively in FIG. 2.

A small child 328 is a user of a play device 324. A media output device 308, in this case a tablet computer, is positioned behind play device, from the child's point of view. The child's tablet 308 has a camera 312 with a field of view 320 that encompasses the space above the play device 324 and encompasses the child's head and shoulders 328.

The play device 324 and the child's tablet 308 are connected wirelessly to a router 302, which connects via the internet 304 to a remote router 306 for communication with the parent 330. The remote router 306 is connected to the parent's media output device 310, in this case a tablet, and their play device 326. The parent's tablet 310 has a camera 314 with a field of view 322 that encompasses the space above the play device 326 and encompasses the parent's head and shoulders 330. Tablet 310 outputs a video stream 318 acquired by the camera 312.

Tablet 308, is operable to output to a user of the first device 328 an indication 316 of the second object B having been released by the second device 326 in response to the first release signal (211 in FIG. 2). Media output device 308 is also operable to output to the user of the first device 328 an indication of an object (B or a different object) being captured 224 by the second device (not shown).

A media acquisition device, in this example tablet 310 with camera 314, is operable to acquire and transmit media representing the second object B having been released by the second device 326 in response to the first release signal, for output by the media output device 308. In this example, the indication is media being a live video (with sound) stream of the ball B. Another type of media is sound. The media acquisition device 314 is operable to acquire and transmit media representing the other object being captured by the second device. Another type of media is animated holographic imagery.

In this example, the tablets 308 and 310 each operate both as media output devices and media acquisition devices. At a given end, the media output device and media acquisition device may be separate devices. At a given end, the media output device and media acquisition device may be integrated in the play device.

Figure 4:
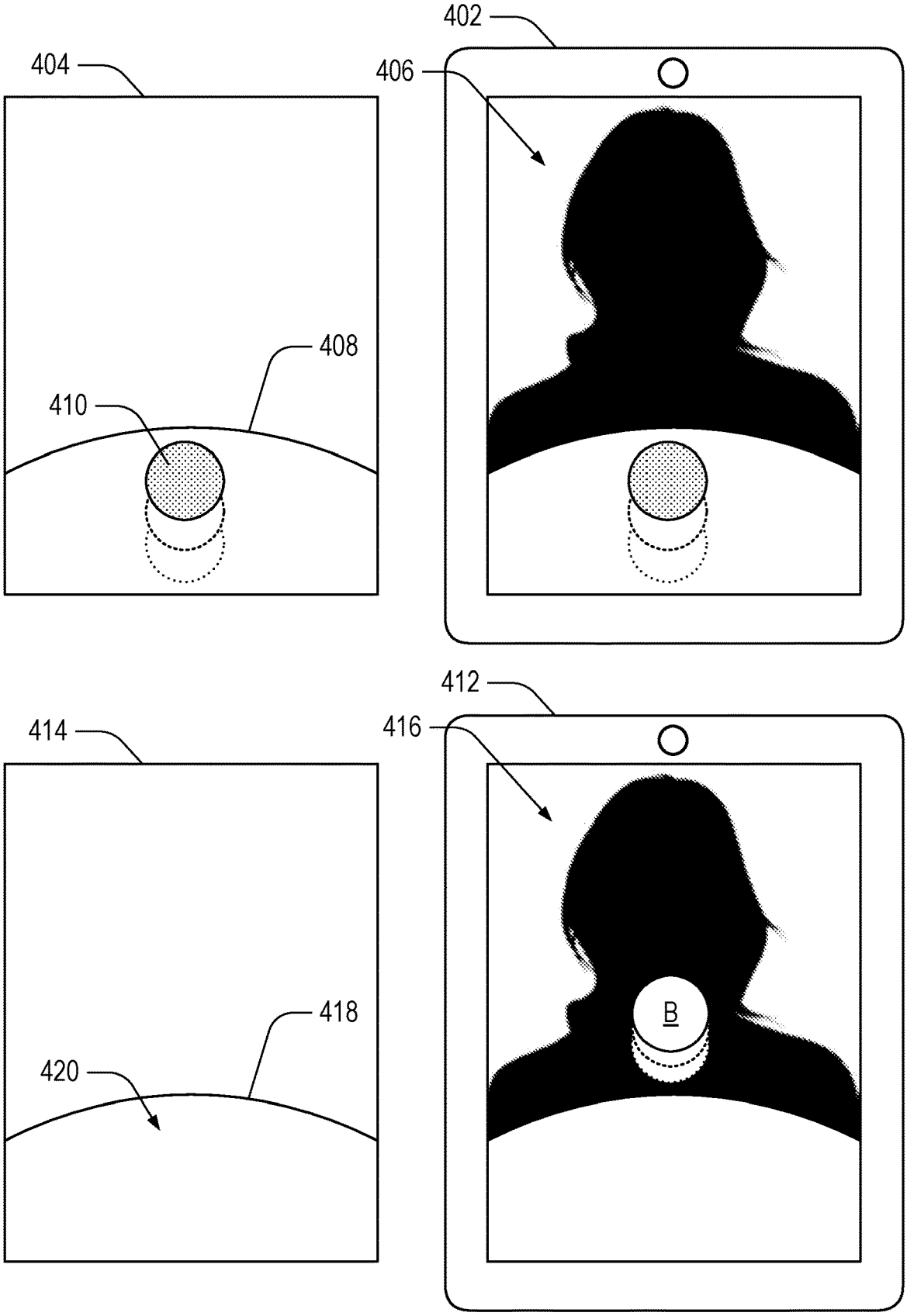
FIG. 4 illustrates, in schematic form, operation of a media sequence module in accordance with an embodiment of the present invention.

FIG. 4 illustrates operation of a media sequence module in accordance with an embodiment of the present invention.

The media sequence module (124 in FIG. 1) is operable to generate a media sequence 404 having a duration corresponding to (or dependent on) latency from the transmission of the first release signal 211 to the release 216 of the second object (ball B), for output by the media output device 402. The duration may also correspond to latency of transmission of media representing the second object being captured by the second play device, from the media output device at the second play device to the media output device 402 at the first play device. In this example, the media sequence is a computer-generated animation of a hill 408 with a virtual ball 410 rolling away from the viewpoint. The media sequence may include sound or may be only a sound effect.

The media sequence module is operable to superimpose the media sequence 404 over an output real-time media sequence 406 representing a user of the second device.

Once the latency period has ended and the animation is complete, the media sequence 414 is rendered with a hill 418 that is empty 420. Meanwhile the media output device 412 shows 416 the ball B having been released by the second device with the media sequence 414 superimposed.

Figure 5:
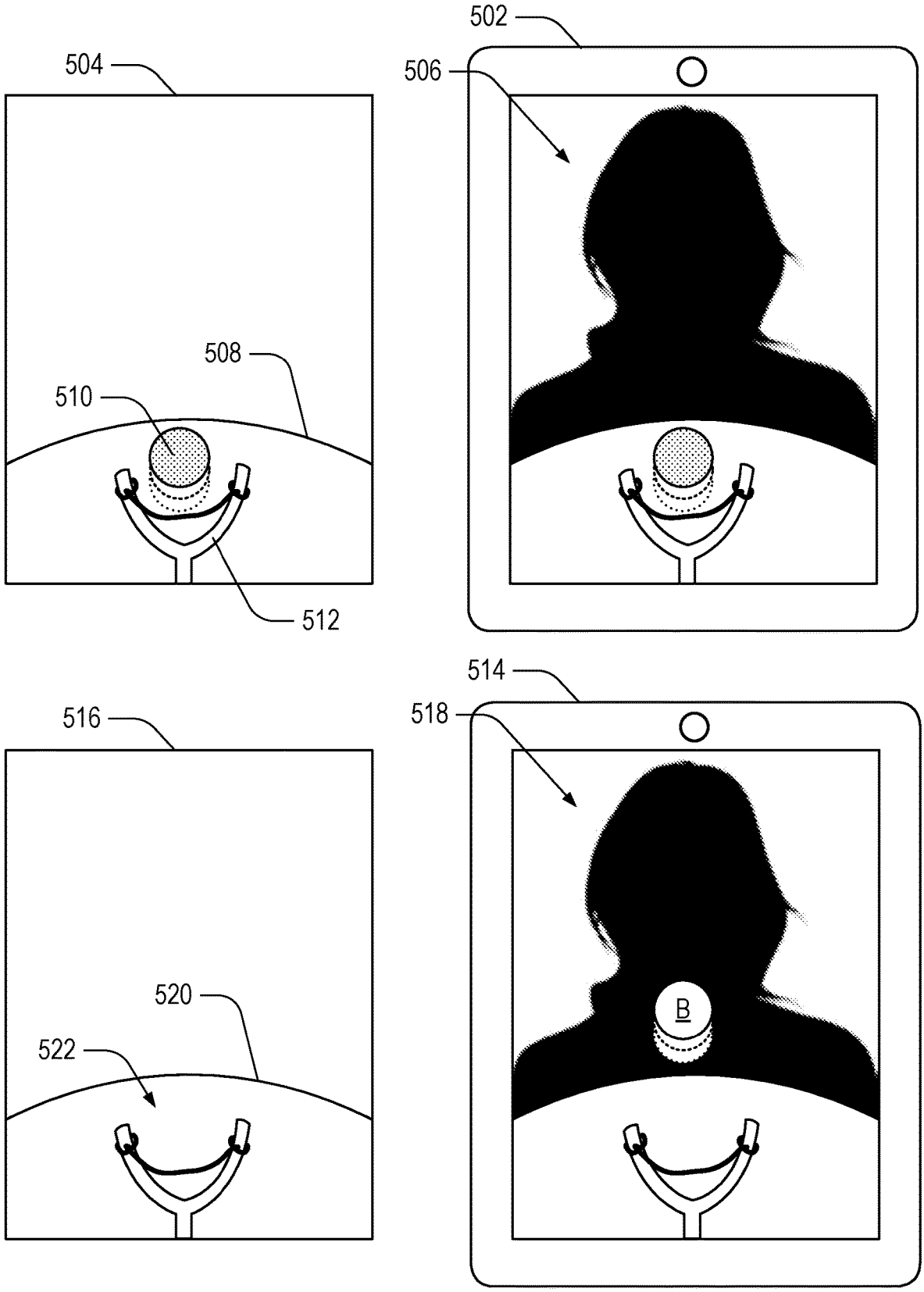
FIG. 5 illustrates, in schematic form, game operation of a media sequence module in accordance with an embodiment of the present invention.

FIG. 5 illustrates game operation of a media sequence module in accordance with an embodiment of the present invention.

A game is instigated when two balls are placed into the paired devices.

As an example of a fetch game, the following sequence of events may be performed.

- It's time for Junior and Mum to play. They are on different continents.
- Each device is turned on and they link visually.
- They decide to play a "fetch" game.
- The distinctive ball is placed in first device by Junior.
- Mum does the same (effectively loading the game).
- A ball appears on screen, loaded into a catapult and is propelled over the hill out of sight. Alternatives to the catapult might be a canon firing the ball or a donkey kicking the ball, but are not restricted to these.
- Optional additional step: Junior activates the game by striking a pressure and/or velocity sensor on the device. The pressure and/or velocity are detected as attributes or are used to modify the attributes. Thus the pressure and/or velocity sensor functions as an attribute detector. This may supplement any attribute sensor in the device.
- At this point the ball flies from Mum's play device across the floor as if Junior has literally fired the ball into Mum's environment.
- Mum shrieks with surprise before "fetching" the ball from the floor.
- Mum replaces the ball into her play device.
- Optional additional step replicates that in the first device: Mum strikes her pressure and/or velocity sensor.
- It then fires out of Junior's device.
- Too young to catch it, it fires past him and lands on the floor.

The fun begins as Junior searches for where the ball landed, and returns it to the device hole, to once again send it across the globe to Mum.

With reference to FIG. 5, the media sequence module (124 in FIG. 1) is operable to generate a media sequence 504 responsive to user input (e.g. a game), between the detection of the capture the first object and the release of the second object, for output by the media output device 502.

One or more of the devices may be provided with user input components, such as buttons, joysticks, pressure and/or velocity sensors, or microphones. These components can be used for game controllers and/or attribute detectors.

The media sequence is an animation of a computer-generated virtual play space, in this example a hill 508 with a virtual ball 510 being fired away from the viewpoint by in this example a catapult 512. The catapult 512 may be controlled by user input for example a pressure/velocity sensor.

The media sequence module is operable to superimpose the media sequence 504 over an output real-time media sequence 506 representing a user of the second device.

Once the game has ended and the animation is complete, the media sequence 516 is rendered with a virtual play space, in this case a hill 520 that has an empty launch device—in this case a catapult 522. Meanwhile the media output device 514 shows 518 the real ball B having been released by the second device with the media sequence 516 superimposed.

On-screen games and associated graphics enhance the play. The users' faces are visible, with only the bottom third (approximately) used for play.

The game may be played using peripherals to control the rendered ball, such as a pressure, velocity or tilt sensitive pad, or such as a breath-sensitive "blowstick" as described below.

A blowstick can be used to blow at the screen or over the hole in the device, to control an object on a rendered surface. A blowstick can be used to blow and control a musical instrument in a rendered band.

A tilt pad can be used for example to: alter a surface rendered on screen to adjust the roll of a ball or other object, for example to adjust the path of a boat depicted on the high seas, or to adjust the path of a plane around the sky.

Figure 6:
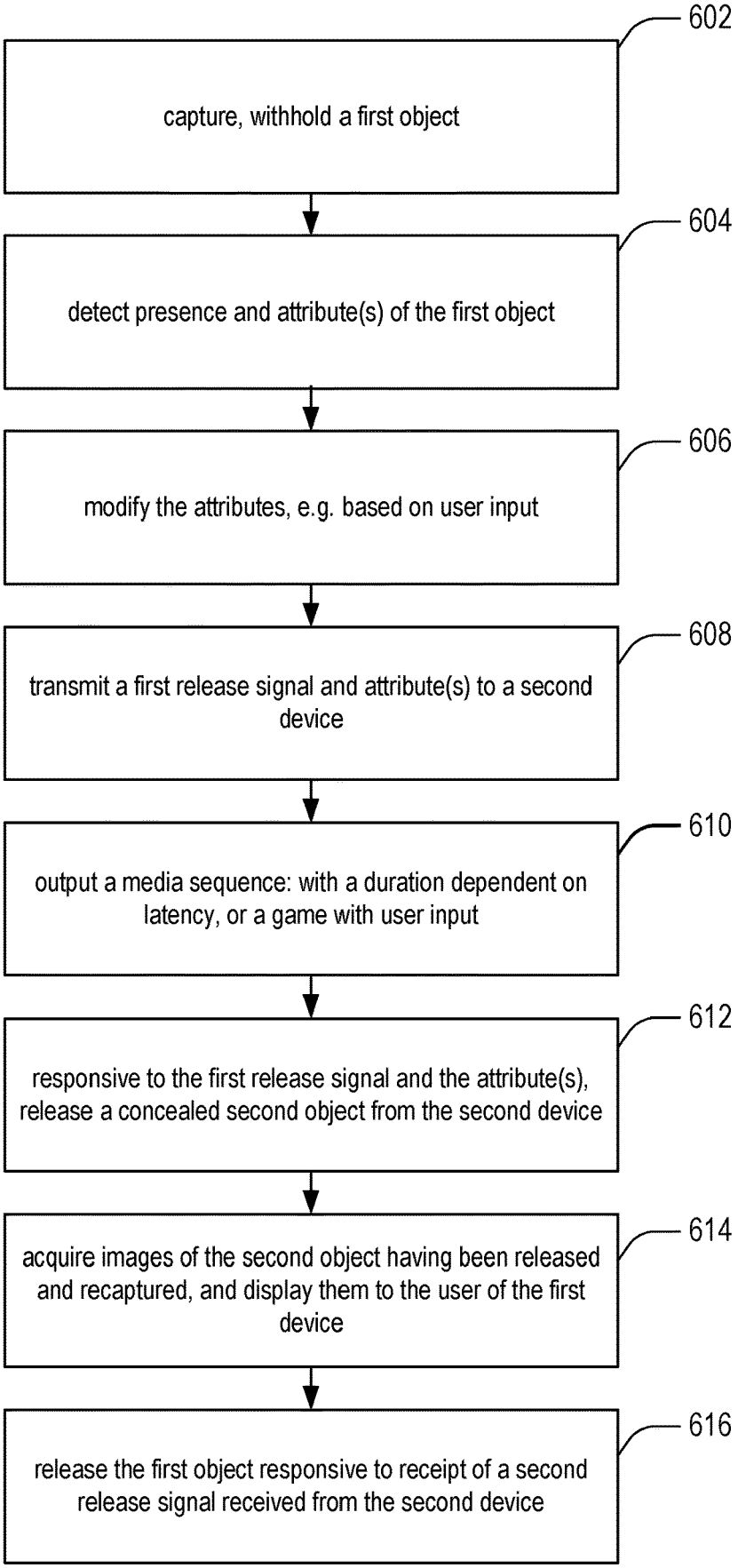
FIG. 6 is a flowchart of a method in accordance with an embodiment of the present invention.

FIG. 6 is a flowchart of a method in accordance with an embodiment of the present invention. In the description of FIG. 6 below, some reference is also made to FIG. 2

The method has the following steps:

602: Capture 206 a first object by a first device. The object is withheld and may be concealed.

604: Detect 206 that the first object has been captured by the first device. Attributes of the first object are detected upon its capture by the first device.

606: Modifying the attributes. The modification may be responsive to user input. For example, the user may set the direction and speed of ejection of the other object upon its release, in a catapult game as described with reference to FIG. 5.

608: Responsive to the detection, transmit 210 a first release signal 211 from the first device configured to cause a second device to release 216 a second object (at step 612). A first attribute signal is transmitted configured to cause the second device to apply the attribute to the second object (at step 612).

610: Generate and output a media sequence (images and/or sound) having a duration dependent on latency from the transmission of the first release signal 211 to the release 216 of the second object. Additionally or alternatively, a media sequence is generated and output responsive to user input (e.g. a game), between the detection of 206 the capture the first object and the release 216 of the second object. The media sequence is superimposed over an output real-time media sequence representing a user of the second device.

612: The first release signal 211 is received 212 at the second device. Responsive to the first release signal, the second object is released 216 by the second device. The attributes detected in step 604 and 610 are applied to the second object. This may involve imparting a force to the second object.

614: Acquiring and transmitting media of the second object having been released by the second device in response to the first release signal 211. The media are output to a user of the first device as an indication of the second object B having been released 216 by the second device in response to the first release signal 211.

616: Detect that another object (which may be the second object or a different object) has been captured 224 by the second device. Responsive to the detection of the capture 224 of the other object by the second device, the second release signal 227 is transmitted (from the second device or an intermediate server) to the first device. Media of the other object being captured by the second device are acquired and transmitted. An indication of an object (ball B or a different object) being captured 224 by the second device is output to a user of the first device.

An attribute of the other object may be detected upon its capture by the second device and one or more second attribute signal may be transmitted configured to cause the first device to apply the one or more attribute to the first object. Attributes may also be modified in a step equivalent to that at 606. Applying the attribute(s) to the first object may involve imparting a force to the first object.

The first object, which has been withheld 210-226 by the first device, is released 230 responsive to receipt of the second release signal 227 configured to indicate that the other object has been captured 224 by the second device.

In the steps above, a captured object may be concealed in the cavity until it is revealed by its release. The object may comprise a ball.

Figure 7:
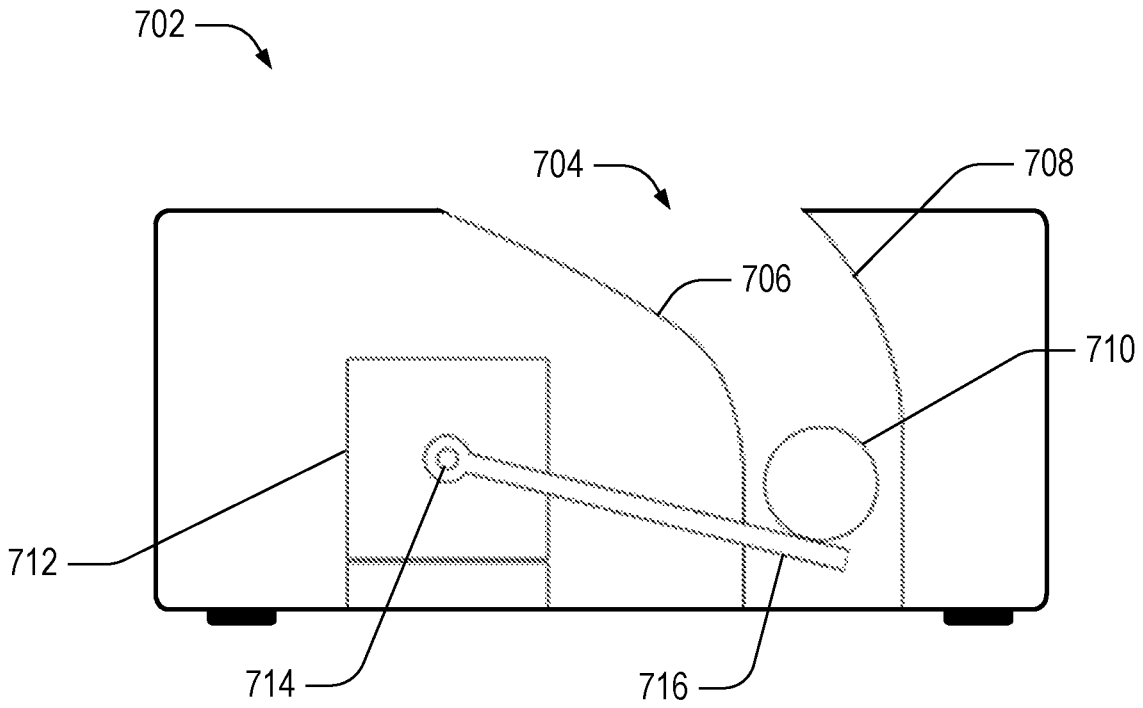
FIG. 7 illustrates, in schematic form, a play device and its eject mechanism in accordance with an embodiment of the present invention.

FIG. 7 illustrates, in schematic form, a play device and its eject mechanism in accordance with an embodiment of the present invention.

A play device 702 is shown in cross section. The hole 704 has a tapered throat, to aid with catching the ball 710. It has tapered sidewalls 706, 708. A stepper motor 712 connected via its shaft 714 to an arm 716. The motor and arm assembly act as a release actuator. In this example, the releasing action is an ejecting action. As the motor turns, the end of the arm moves upwards and ejects the ball. The motor can move slowly at first to move the ball around the bend in the sidewalls that has been acting to conceal the captured ball. This reduces energy being lost to the sidewalls. Once past the bend, the motor speeds up and it applies more force to the ball, which is ejected out of the throat 704.

In the remaining Figures, features with reference numerals the same as shown in earlier Figures are the same features, and the description of those features given above in relation to the earlier Figures should be used to interpret the latter features.

Figure 8:
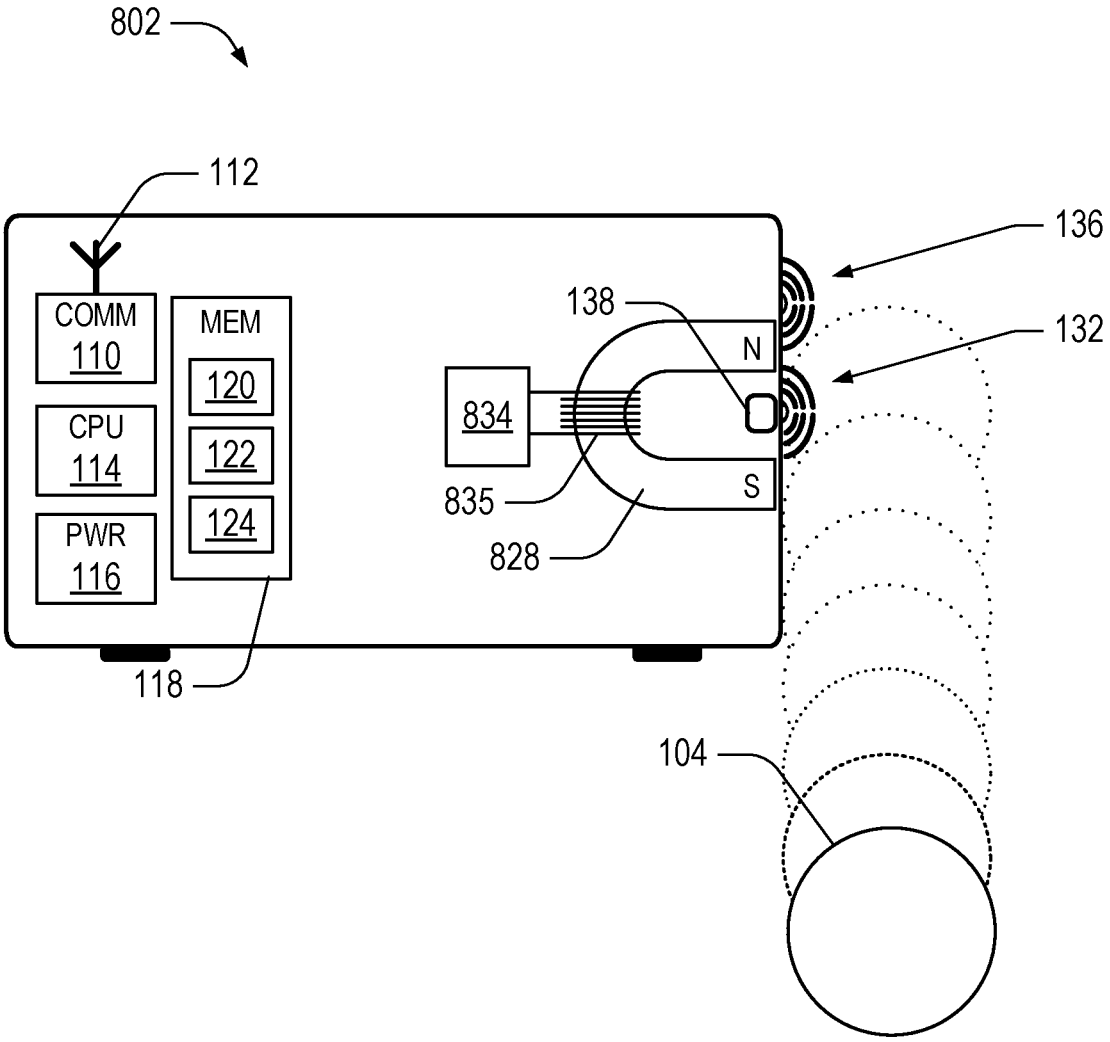
FIG. 8 illustrates, in schematic form, a play device with a magnetic capture arrangement in accordance with an embodiment of the present invention.

FIG. 8 illustrates, in schematic form, a play device 802 with a magnetic capture arrangement in accordance with an embodiment of the present invention. In this embodiment, instead of a cavity, as shown with reference to FIG. 1, the capture arrangement uses an electromagnet. The ball is made of material that is attracted to a magnet, thus the ball can be captured by an energised electromagnet. The electromagnet has a core 828, magnetised by a solenoid coil 835, with the north and south poles N and S shown. Current is provided to the coil to energise the electromagnet by a power supply 834, which acts as a release actuator by halting the current in the coil thereby de-magnetising the core. The power supply 834 may be controlled by the CPU 114. The ball 104 is shown just after release, as it falls down by gravity. Although the magnet in this example holds the ball to the side of the play device, it may be located at another surface, such as the top or bottom, or in a cavity or hole going through the device.

In embodiments, the captured object may be supported on a platform until it is released. The platform may be on top of the play device, or within it, such as in a cavity. For example, there may be no cavity and the object may rest on the platform of the top surface of the play device, held in place by gravity.

Figure 9:
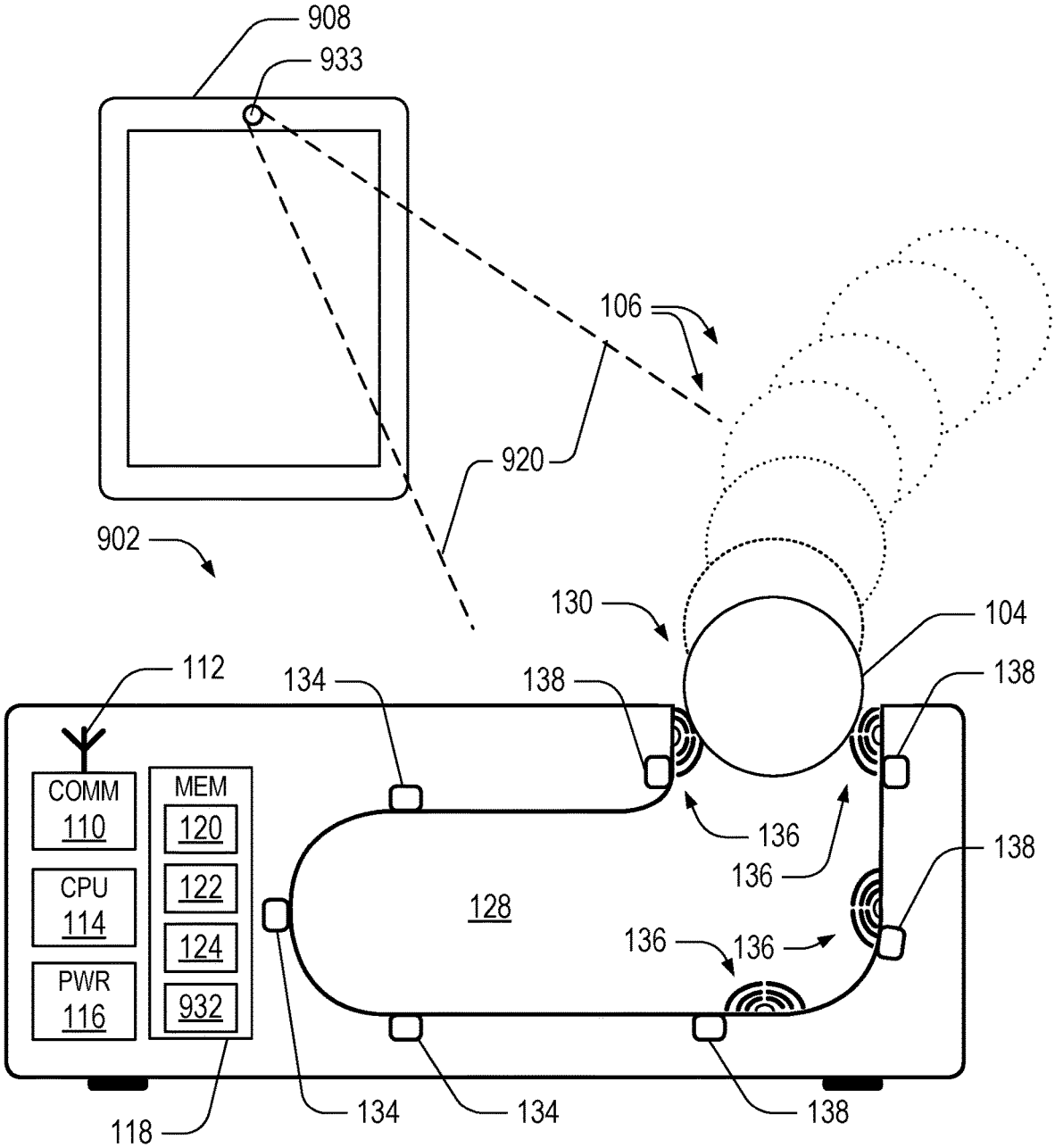
FIG. 9 illustrates, in schematic form, a play device with a remote object sensor in accordance with an embodiment of the present invention.

FIG. 9 illustrates, in schematic form, a play device with a remote object sensor in accordance with an embodiment of the present invention. A tablet computer 908 functions as a remote object sensor. The tablet computer 908 is remote from the device 902 and has a camera 933 that has a field of view 920 spanning the hole 130 at the entrance to the cavity 128. The tablet computer may also function as the media output device 308 as described with reference to FIG. 3. The processor in the tablet controls the camera 933 to acquire video images and runs image processing software to detect an object being captured. The tablet computer thus processes video images from the camera to identify the ball 104 and track its entry into the hole 130.

Instead of the object detector being a sensor 132 in the play device as shown in FIG. 1, the object detector in this example is a software detection module 932 which communicates with the tablet computer 908, using for example Bluetooth or WiFi wireless connection between the play device 102 and the tablet computer 908. Once the tablet computer determines that a ball has entered the hole and has therefore been captured, it then sends a detection signal to the detection module 932, so that the play device can detect that the object has been captured.

The object detector 932 may be simply processing logic that receives an object detection message, for example from an external object detection sensor, and causes the device to respond to detection of capture of an object.

Figure 10:
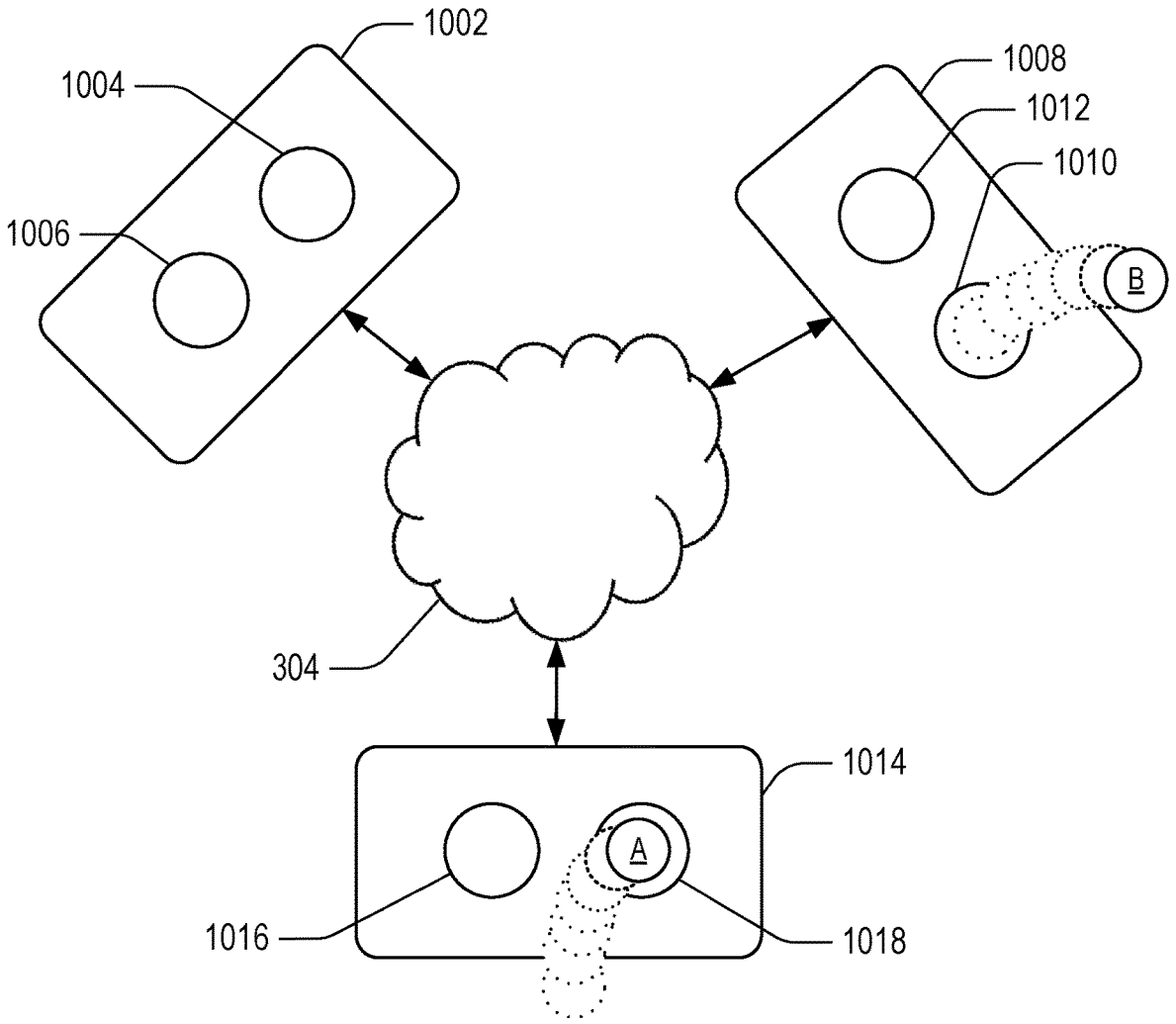
FIG. 10 illustrates, in schematic form, a play apparatus with three play devices, in accordance with an embodiment of the present invention.

FIG. 10 illustrates, in schematic form, a play apparatus with three play devices, in accordance with an embodiment of the present invention. The first play device, 1002 has left- and right-hand holes 1004 and 1006. The second play device, 1008 has left- and right-hand holes 1010 and 1012. The third play device, 1014 has left- and right-hand holes 1016 and 1018.

Having three or more play devices allows users to pass balls in different ways rather than backwards and forwards. They can choose who they pass the ball to. In this example, three players can pass a ball to one or other of two players. Each player may be in a different location and has a play device. The play devices are all connected via the internet 304. Shown here, the user of the third play device 1014 puts the ball A into their right-had hole 1018. By choosing the right-hand hole, sensors associated with that hole detect the attribute, which is labelled "pass to the right". This causes the release signal to be sent from play device 1014 to the second play device 1008, rather than play device 1002. This causes the second play device 1008 to release and eject the ball B. If the user of the third play device had put the back in the left-hand hole 1016, then the release signal would have been sent instead to the first play device 1002.

One player may act as a "games master" and they may have control of the game play of the other players. This may involve for example modifying, interrupting or overriding the release signals the release signals between the other players. Thus, they may for example block a ball pass between the other payers or bat a ball back to a player, or steal the ball to their own play device, instead of allowing it to pass to another player. The games master may act to enforce rules of game play or may suspend or terminate play. The role of games master between two or more players may be performed by a person without their own play device, or it may be performed automatically by software running on a processor in a play device or externally.

Figure 11:
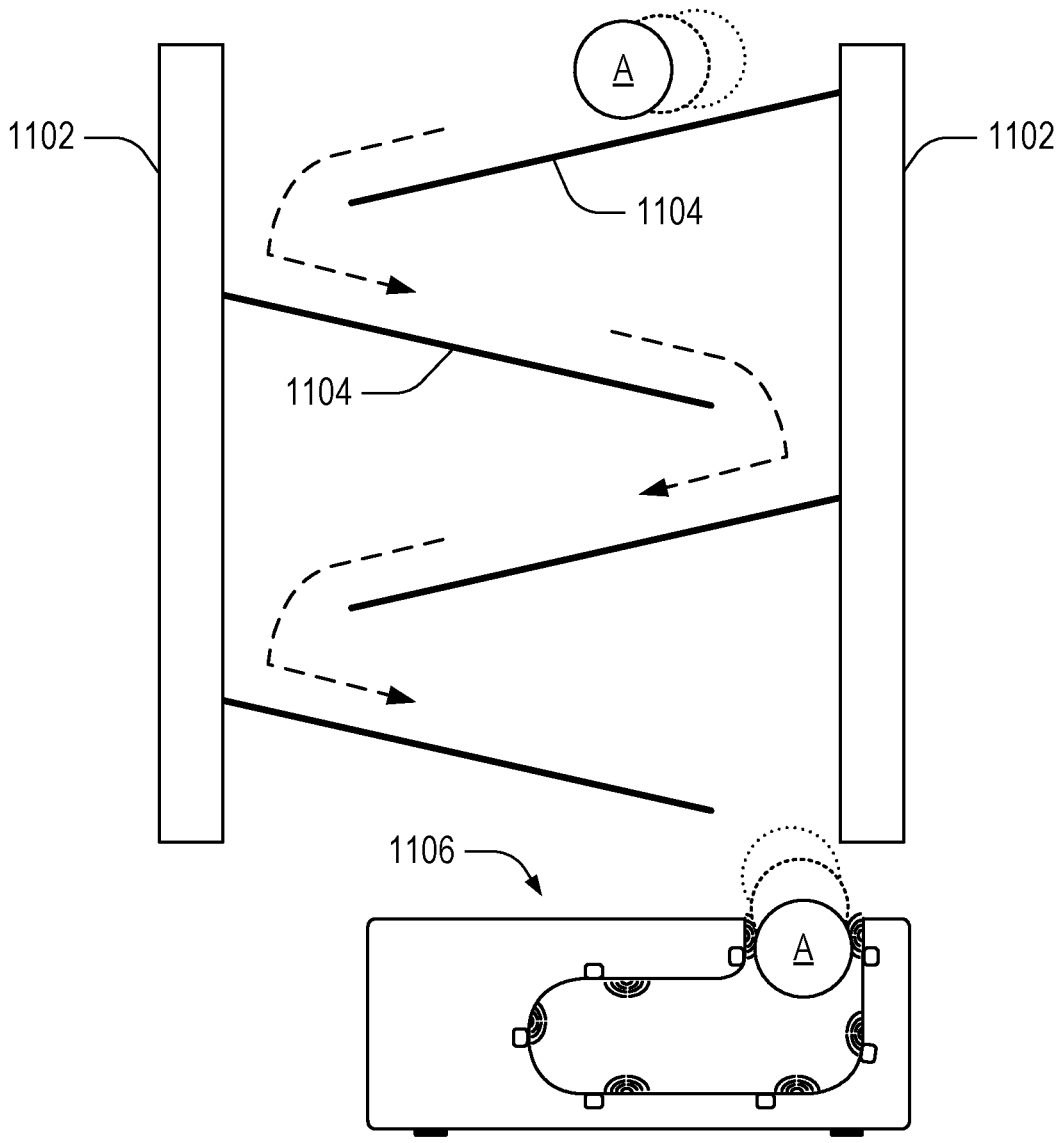
FIG. 11 illustrates, in schematic form, a play device with an ancillary piece in accordance with an embodiment of the present invention.
Figure 12:
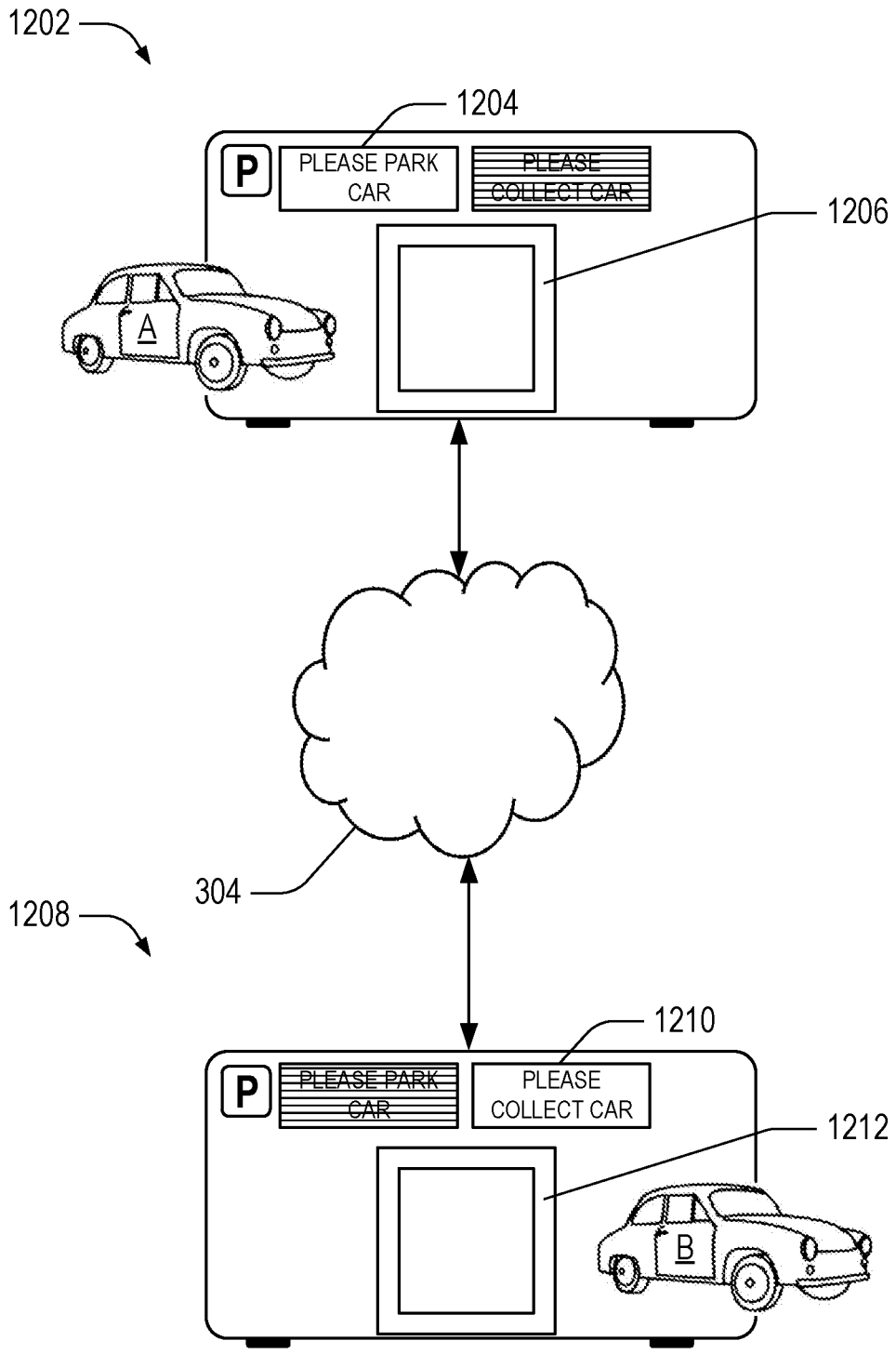
FIG. 12 illustrates, in schematic form, play devices with complex objects in accordance with an embodiment of the present invention.

FIG. 11 illustrates, in schematic form, a play device with an ancillary piece in accordance with an embodiment of the present invention. The ancillary piece in this example is a ball run 1102. A ball A is placed at the top of the ball run 1102 and it rolls down the ramps 1104 until it is deposited in the play device 1106. An ancillary piece may also guide an object away from the play device. For example, a first toy car on an ancillary piece of track leading to a cavity may be guided at speed into the cavity, causing a second car to hurtle out at the other end onto another track, in accordance with the embodiments described above. FIG. 12 shows another toy car example.

FIG. 12 illustrates, in schematic form, play devices with complex objects in accordance with an embodiment of the present invention.

A pair of play devices 1202, 1208 are configured to act as toy car parking garages. The play devices 1202, 1208 are connected via the internet 304. The play devices may operate in the same way as described with reference to FIGS. 1 to 7. The cavity is configured to look like a parking garage entry 1206, 1212. Each entry may have a manually or automatically powered door, which functions as a shutter to conceal an object placed in the cavity. The objects in this example are more complex than simple balls, being toy cars A, B. An additional feature is an indicator 1204 that can request the user to park (i.e. insert) the car A (i.e. object) in the play device. In this example the indicator is a backlit sign 1204 saying "PLEASE PARK CAR", but other indicators may be controlled by the CPU of the respective play device to prompt capture or retrieval of an object. Instead of a backlit sign, a message displayed on the tablet computer may be used as a prompt. Alternatively, for example, a spoken request may be played through a loudspeaker in the play device or in the tablet computer. At the other play device 1208, upon receipt of a release signal indicating that the other car A has been parked in the first play device 1202, the car B is released using a backlit sign 1210 saying "PLEASE COLLECT CAR", which requests that the user open the door (which may be unlocked by a release actuator) and collect the car B.

The object may be a volume of solid, such as a ball, or a volume of liquid or gas.

Advantages of embodiments of the present invention include:

Communication is via tangible objects rather than words. Play is unstructured and mimics play with real objects when participants are in the same room. Play is in real time. Embodiments enable parents to engage with their children even when they are absent.

The invention claimed is:

1. A play apparatus comprising a pair of devices, each device comprising:

a capture arrangement configured to capture an object, wherein the capture arrangement comprises a cavity configured to conceal the captured object until it is revealed by its release;

an object detector configured to detect that the object has been captured;

a transmission module configured to transmit a release signal, and a receiver module configured to receive a release signal, wherein the transmission module and receiver modules are embodied in a non-transitory computer-readable medium of the apparatus or of each pair of devices; and a release actuator configured to release the captured object, wherein a first device of the pair of devices is configured to:

respond to detection of capture by the first device of a first object, transmit a first release signal configured to cause a second device of the pair of devices to release a second object; and withhold the first object until releasing it, responsive to receipt of a second release signal configured to indicate that another object has been captured by the second device;

wherein the play apparatus further comprises:

a media output device configured to output to a user of the first device an indication of the second object having been released by the second device in response to the first release signal; and a media acquisition device configured to acquire and transmit media representing the second object having been released by the second device in response to the first release signal, for output by the media output device.

2. The play apparatus of claim 1, wherein the release actuator is configured to release the captured object by ejecting it.

3. The play apparatus of claim 1, wherein the second device is configured to:

receive the first release signal transmitted by the first device;

responsive to the first release signal, release the second object;

detect that the other object has been captured by the second device; and responsive to the detection of the capture of the other object by the second device, transmit the second release signal to the first device.

4. The play apparatus of claim 1, further comprising a media sequence module embodied in a non-transitory computer-readable medium of the apparatus or of each pair of devices configured to generate a media sequence having a duration corresponding to latency from the transmission of the first release signal to the release of the second object, for output by a media output device.

5. The play apparatus of claim 1, further comprising a media sequence module embodied in a non-transitory computer-readable medium of the apparatus or of each pair of devices configured to generate a media sequence responsive to user input, between the detection of the capture of the first object and the release of the second object, for output by a media output device.

6. The play apparatus of claim 1, wherein each device comprises an attribute detector module embodied in a non-transitory computer-readable medium of the apparatus or of each pair of devices configured to detect an attribute of an object upon its capture and wherein the transmission module of the first device is further configured to transmit a first attribute signal configured to cause the second device to apply the attribute to the second object.

7. The play apparatus of claim 6, wherein each device comprises an attribute actuator configured to apply an attribute to an object.

8. The play apparatus of claim 7, wherein applying the attribute comprises imparting a force to the object.

9. The play apparatus of claim 7, wherein applying the attribute comprises selecting an object to release from a plurality of objects captured in the device from which the selection is made.

10. A method comprising the steps:

capture a first object by a first device;

detect that the first object has been captured by the first device;

responsive to the detection, transmit a first release signal from the first device configured to cause a second device to release a second object;

outputting to a user of the first device an indication of the second object having been released by the second device in response to the first release signal;

withholding of the first object by the first device until releasing it responsive to receipt of a second release signal configured to indicate that the second or a third object has been captured by the second device; and concealing the captured first object in a cavity until it is revealed by its release, wherein the step of outputting to the user an indication of the second object having been released comprises acquiring and transmitting media of the second object having been released by the second device in response to the first release signal.

11. The method of claim 10, wherein the step of releasing the first object comprises ejecting it.

12. The method of claim 10, further comprising the steps: generate and output a media sequence having a duration dependent on latency from the transmission of the first release signal to the release of the second object.

13. The method of claim 10, further comprising the steps: generate and output a media sequence responsive to user input, between the detection of the capture of the first object and the release of the second object.

14. The method of claim 10, further comprising the steps:

receive the first release signal;

responsive to the first release signal, release of the second object by the second device;

detect that the other object has been captured by the second device; and responsive to the detection of the capture of the other object by the second device, transmit the second release signal to the first device.

15. A method comprising the steps:

capturing a first object by a first device;

detecting that the first object has been captured by the first device;

responsive to the detection, transmit a first release signal from the first device configured to cause a second device to release a second object;

withholding of the first object by the first device until releasing it responsive to receipt of a second release signal configured to indicate that the second or a third object has been captured by the second device;

concealing the captured first object in a cavity until it is revealed by its release; and outputting to a user of the first device an indication of the second or the third object being captured by the second device, wherein the step of outputting to the user of the first device an indication of the second or the third object being captured by the second device comprises acquiring and transmitting media of the second or the third object being captured by the second device.

* * * * *